United States Patent [19]

Whitman

[11] Patent Number: 4,612,676

[45] Date of Patent: Sep. 23, 1986

[54] URINAL ATTACHMENT FOR TOILET

[76] Inventor: Victoria E. Whitman, P.O. Box 377, Black Diamond, Wash. 98010

[21] Appl. No.: 742,205

[22] Filed: Jun. 7, 1985

[51] Int. Cl.[4] ..... E03D 9/00

[52] U.S. Cl. ..... 4/300.3; 4/301; 4/DIG. 5

[58] Field of Search ..... 4/300, 300.3, 301, 311, 4/454, 462, 114.1, DIG. 5, 144.1–144.4; 434/247

[56] References Cited

U.S. PATENT DOCUMENTS

| | | | |
|---|---|---|---|
| 45,315 | 12/1884 | Carr . | |
| 134,315 | 12/1872 | Robinson | 4/301 |
| 473,714 | 4/1892 | Schubert | 4/462 |
| 2,489,967 | 11/1949 | Lavine | 4/DIG. 5 |
| 2,583,718 | 1/1952 | Walls . | |
| 2,791,780 | 5/1957 | Krischer | 4/301 |
| 2,980,919 | 4/1961 | Otto et al. . | |
| 3,071,778 | 1/1963 | Renshaw . | |
| 3,914,803 | 10/1975 | Gregovski . | |
| 4,060,859 | 12/1977 | Anderson | 4/300 |
| 4,282,611 | 8/1981 | O'Day | 4/301 |
| 4,348,776 | 9/1982 | Sarjeant | 4/300.3 |
| 4,488,321 | 12/1984 | Brunton | 4/300.3 |

*Primary Examiner*—Stephen Marcus
*Assistant Examiner*—Linda J. Sholl
*Attorney, Agent, or Firm*—Joan H. Pauly

[57] ABSTRACT

A main body (22) has a downwardly-directed outlet opening (28) and a forwardly-directed inlet opening (30). A vertical wall (34) depends downwardly from opposite sidewalls (26) of body (22), is spaced rearwardly from inlet opening (30), and engages the inner vertical surface (8) of toilet bowl rim (6). A sloping horizontal wall (36) extends forwardly from the top edge of wall (34). A flexible vertical leg (38, 40) depends downwardly from the front of wall (36) and engages the outer vertical surface (10) of rim (6). Rim (6) is securely gripped between wall (34) and leg (38, 40). Body (22) preferably has a top wall (42) and a top lip (44) that help to form a moisture catching recess (46) when the attachment (20, 20') is upside down. A funnel-like portion (32, 32') extends down into toilet bowl (4) and may have a cutout (52) to make water in bowl (4) visible to a user.

14 Claims, 9 Drawing Figures

Fig. 4
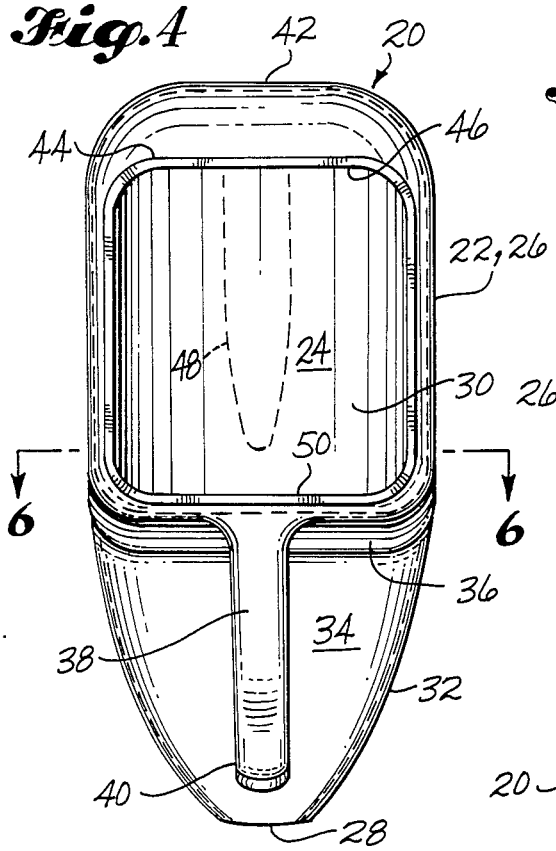
Fig. 5
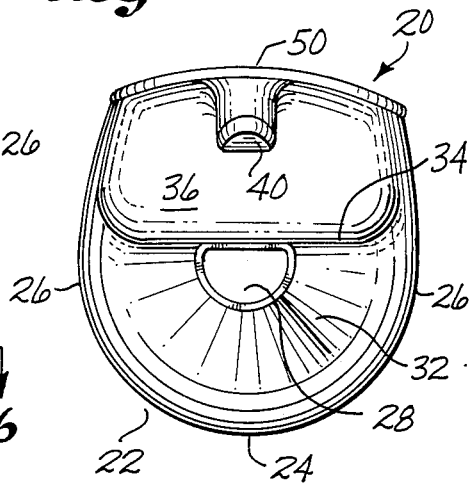
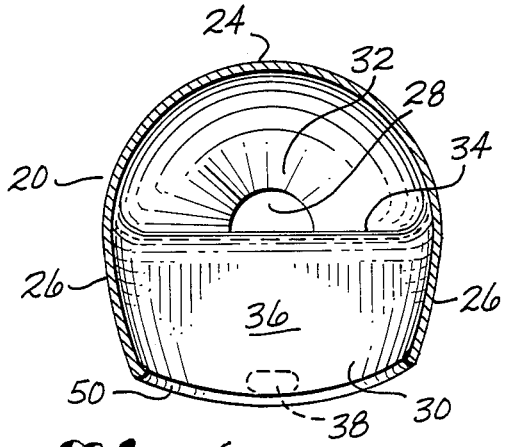
Fig. 7
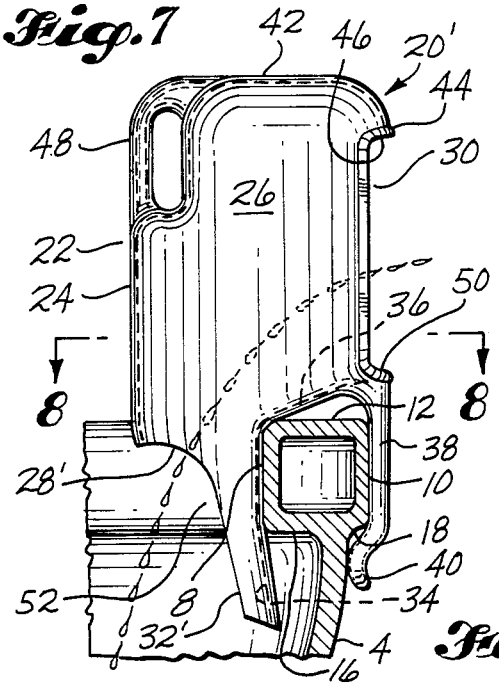
Fig. 6
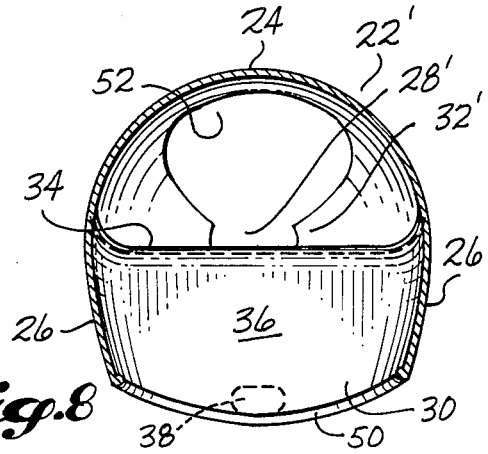
Fig. 8

URINAL ATTACHMENT FOR TOILET

DESCRIPTION

1. Technical Field

This invention relates to urinal attachments and, more particularly, to such an attachment having a generally vertical inlet opening that is spaced forwardly from the inner edge of the toilet bowl rim, and an inner vertical wall and an outer flexible leg between which a front portion of such rim is gripped.

2. Background Art

Young male children are frequently ready and even eager to use a toilet as a urinal before they have developed sufficiently accurate aim to preventing wetting of outer portions of the toilet bowl and the area around the toilet. One means that has been proposed for avoiding the need to clean the outside of the toilet bowl and the surrounding area at very frequent intervals is to provide an attachment for the toilet that acts as a splash guard.

Known attachments have a number of serious drawbacks. Such attachments generally take the form of a shield that fits around the sides and rear of the inside of the toilet bowl. The shield faces forwardly and presents an inlet opening that is even with or spaced rearwardly of the inner edge of the toilet bowl rim. This arrangement is generally ineffective for preventing spillage around the front portion of the toilet bowl. Known attachments also tend to be relatively complex and/or large and, thus, are relatively difficult to attach to and remove from the toilet bowl. The shield of known attachments is usually attached to the toilet bowl rim by a flange arrangement that engages a large proportion of the rim surface area. Therefore, the attachments have relatively large outer surface areas that contact and are likely to be soiled by the toilet bowl rim. This makes it relatively difficult to handle the attachment and to keep it in a reasonably clean condition. Another problem with known attachments that must be removed from the toilet when the toilet is not being used as a urinal is that they are not adapted to be easily stored in that they tend to drip on any surface on which they are placed and they also occupy a relatively large amount of space. Attempts to avoid this problem by allowing the toilet seat to be lowered and used without removing the attachment have resulted in reducing the effectiveness of the shield or making the shield unduly complicated and difficult to clean.

Shield attachments for converting a toilet into a urinal are disclosed in U.S. Pat. No. 2,980,919, granted Apr. 25, 1961, to C. H. Otto et al; U.S. Pat. No. 3,071,778, granted Jan. 8, 1963, to H. M. Renshaw; U.S. Pat. No. 3,914,803, granted Oct. 28, 1975, to G. Gregovski; and U.S. Pat. No. 4,348,776, granted Sept. 14, 1982, to D. C. Sarjeant. The Otto et al attachment has a flange arrangement that engages inner portions of the sides and rear of the toilet bowl rim. The Renshaw attachment has a flange arrangement that engages the top surface and portions of the outer edge of the rim all around the rim. In one embodiment of the Renshaw attachment, the shield has a tapered configuration and depends downwardly for a short distance into the toilet bowl. The Gregovski splash shield attaches to the seat of the toilet and is moved into its use position in which it fits around the outer sides of the toilet bowl by raising the seat. Sarjeant discloses a shield that is attached to the toilet seat and has lateral flanges that rest on the toilet bowl rim. The Sarjeant shield is relatively complicated and has a plurality of segments that collapse into a nested arrangement when the toilet seat is lowered.

U.S. Pat. No. 45,315, granted Dec. 6, 1864, to W. S. Carr, discloses a urinal that pivots between a storage position next to a wall and a use position projecting from the wall. U.S. Pat. No. 2,583,718, granted Jan. 29, 1952, to D. W. Walls, discloses a shield attachment for a toilet for use by colostomy patients during irrigation of the bowel.

The above patents and the prior art that is discussed and/or cited therein should be studied for the purpose of putting the present invention into proper perspective relative to the prior art.

DISCLOSURE OF THE INVENTION

The subject of the invention is a urinal attachment for mounting on the rim of a toilet bowl. According to an aspect of the invention, the attachment comprises a receptacle having a rear wall portion and opposite sidewall portions defining a downwardly-directed outlet opening and a forwardly-directed inlet opening. A substantially vertical inner rim-engaging wall depends downwardly from and extends between the opposite sidewall portions. This rim-engaging wall is spaced rearwardly from the inlet opening and engages an inner vertical surface of a front portion of the toilet bowl rim. A generally horizontal wall extends generally forwardly from the top edge of the rim-engaging wall. Substantially vertical leg means depends downwardly from a forward portion of the horizontal wall for engaging an outer vertical surface of such front portion of the rim. The leg means is sufficiently flexible and resilient to permit the attachment to be removably positioned with such front portion of the rim securely gripped between the rim-engaging wall and the leg means.

The basic structure of the urinal attachment of the invention solves a number of the problems associated with known splash shield attachments. The positioning of the inner rim-engaging wall rearwardly of the inlet opening moves the inlet opening forward of the inner edge of the toilet bowl rim. This forward shifting of the inlet opening makes any misses much less likely and helps prevent spillage around the front portion of the toilet bowl. The structure of the attachment of the invention is relatively simply, and the size of the attachment may be kept to a minimum. Thus, the attachment is relatively inexpensive to manufacture and easy to handle. The combination of the inner rim-engaging wall and the vertical leg means between which a front portion of the toilet bowl rim is securely gripped makes it easy to install the attachment on a toilet bowl and remove it therefrom. The gripping of the rim between such wall and leg means also makes it possible to minimize the areas of contact between the attachment and the toilet bowl to in turn make it easier to keep the attachment in a reasonably clean condition.

According to another aspect of the invention, the receptacle of the attachment also has a top wall and a top lip that depends generally downwardly from a forward edge of the top wall. The top wall is dimensioned and positioned to allow the attachment, when not in use, to be placed upside down on a flat surface resting on the top wall. The top wall and the top lip form, with the rear wall portion and the sidewall portions, a recess for catching and containing moisture when the attachment is upside down. This arrangement solves the problem of difficulty in storing a urinal attachment without reducing the effectiveness of the attachment or unduly complicating its structure. The attachment of the invention may be removed easily and quickly from the toilet bowl, turned upside down, and set on the floor next to the toilet. The design of the attachment permits it to be kept fairly small so that it may be placed in a position on the floor in which it is out of the way and inconspicuous. The top recess arrangement prevents moisture in the attachment from dripping onto the floor or other surfaces.

A preferred feature of the attachment is the provision of a handle attached to an exterior portion of the receptacle, preferably a rear surface of the rear wall portion. This feature further facilitates the easy installation and removal of the attachment from the toilet bowl rim and the handling of the attachment when it is being stored or cleaned.

Another preferred feature of the invention is providing the generally horizontal wall with a downward slope from the inlet opening to the outlet opening. This prevents moisture from accumulating on the generally horizontal wall. In the preferred embodiment, a bottom lip extends generally upwardly from the forward edge of the sloping generally horizontal wall to define the lower edge of the inlet opening.

The preferred embodiment of the leg means includes an essentially straight upper portion and a lower portion. The upper portion engages the outer vertical surface of the toilet bowl rim. The lower portion bends rearwardly and downwardly from the upper portion to extend under the rim to help prevent unintended movement of the attachment relative to the rim.

The preferred embodiment of the attachment includes a substantially vertical funnel-like portion formed by the inner rim-engaging wall and downward extensions of the rear wall portion and the sidewall portions. This funnel-like portion directs liquid down into the toilet bowl. An optional feature is providing such a funnel-like portion which has a rear portion that is open to allow a person using the attachment to see and aim at water in the toilet bowl. This optional feature is particularly useful when a somewhat older child is using the attachment since it helps to increase interest in using the attachment and also provides a means for practicing accurate aim.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 4 is a front elevational view of the attachment shown in FIGS. 1-3.

FIG. 5 is a bottom plan view of the attachment shown in FIGS. 1-4.

FIG. 6 is a sectional view taken along the line 6—6 in FIG. 4.

FIG. 7 is like FIG. 2 except that it shows a modified form of the preferred embodiment.

FIG. 8 is a sectional view taken along the line 8—8 in FIG. 7.

BEST MODES FOR CARRYING OUT THE INVENTION

Figure 1:
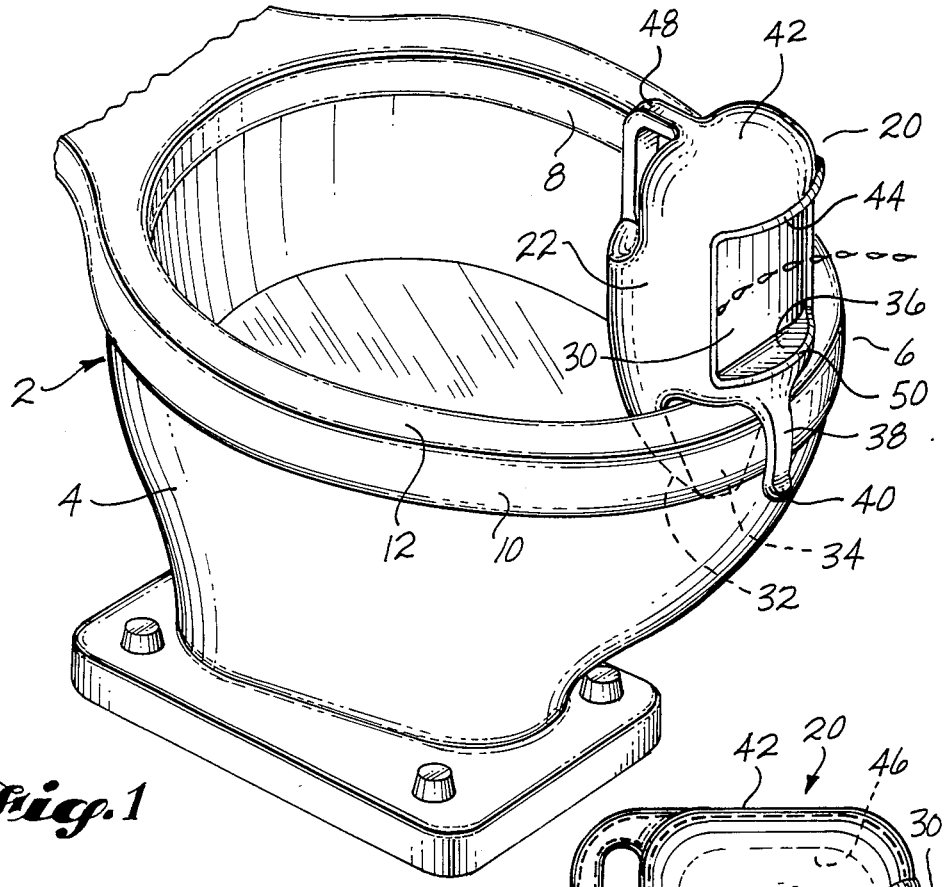
FIG. 1 is a pictorial view of the preferred embodiment of the attachment of the invention installed in its use position on the rim of a toilet bowl.

The drawings show two embodiments of an attachment 20, 20' that are constructed according to the invention and that also constitute the best modes of the invention currently known to the applicant. FIGS. 1, 2, 7, and 9 illustrate a typical type of toilet 2 with which the attachment 20, 20' of the invention may be used to advantage. It is of course to be understood that the toilet 2 forms no part of the present invention and is shown and described herein solely for the purpose of illustrating the use of the attachment 20, 20' of the invention. It is also intended to be understood that the attachment 20, 20' may be used to advantage with other types of toilets, including virtually all flush toilets currently in use.

The toilet 2 shown in the drawings is typical of conventional toilets and includes a bowl 4 having a rim 6. The rim 6 has an inner vertical surface 8 and an outer vertical surface 10. A horizontal top rim surface 12 extends between the top edges of the vertical surfaces 8, 10. Since the rim 6 is thicker than the main body of the bowl 4, it has an inner bottom surface 16 and an outer bottom surface 18.

The unmodified preferred embodiment of the attachment 20 includes a main body portion forming a receptacle 22, which has a rear wall portion 24 and opposite sidewall portions 26. The walls of the receptacle 22 define a downwardly-directed outlet opening 28 and an essentially vertical forwardly-directed inlet opening 30. The attachment 20 also includes means for gripping a front portion of the toilet bowl rim 6. The gripping means includes outer substantially vertical leg means 38, 40 and a substantially vertical inner rim-engaging wall 34. The wall 34 depends downwardly from and extends between the opposite sidewall portions 26 and intersects each of the sidewalls 26 at about its midpoint from front to rear. This positioning of the wall 34 spaces it rearwardly from the inlet opening 30 to bring the inlet opening 30 closer to a user of the attachment and, thus, help prevent any spillage.

Figure 2:
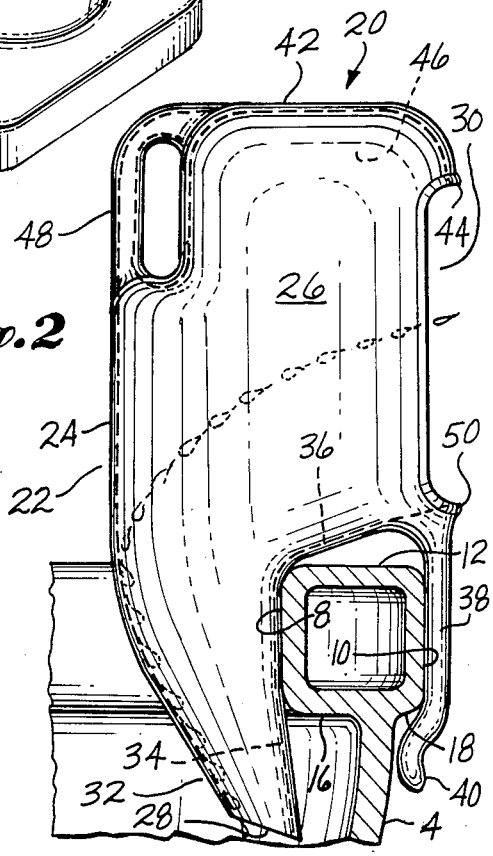
FIG. 2 is a side elevational view of the attachment and toilet bowl shown in FIG. 1, with the bowl shown in section.
Figure 3:
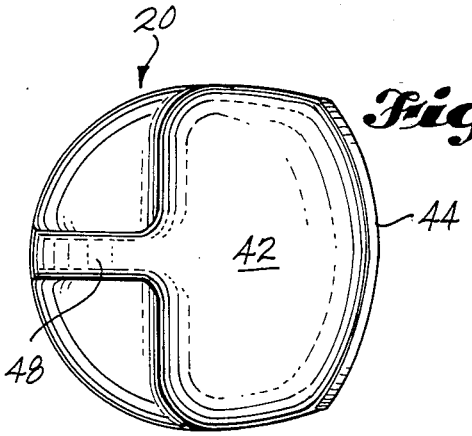
FIG. 3 is a top plan view of the attachment shown in FIGS. 1 and 2.

Referring to FIGS. 1 and 2, when the attachment 20 is installed in its use position on a toilet bowl 4, the inner rim-engaging wall 34 engages the inner vertical surface 8 of the front portion of the rim 6 and the leg means 38, 40 engages the outer vertical surface 10 of such front portion of the rim 6. A generally horizontal wall 36 extends generally forwardly from the top edge of the rim-engaging wall 34. The leg means 38, 40 depends downwardly from the forward portion of the horizontal wall 36. Preferably, the wall 36 slopes downwardly from the leg means 38, 40 to the vertical wall 34, and from the inlet opening 30 to the outlet opening 28, to prevent moisture from accumulating on the wall 36. A bottom lip 50 extends generally upwardly from the forward edge of wall 36 to define the lower edge of inlet opening 30. As can best be seen in FIG. 2, when the attachment 20 is installed on a toilet bowl rim 6, the front portion of the rim 6 is gripped between the vertical wall 34 and the leg means 38, 40 and the generally horizontal wall 36 is positioned above the top surface 12 of the rim 6. The leg means 38, 40 is sufficiently flexible and resilient to permit the attachment 20 to be removably installed in its use position on a toilet bowl 4 with the front portion of the rim 6 of the bowl 4 securely gripped between the rim-engaging vertical wall 34 and the leg means 38, 40.

Although in the preferred embodiment shown in the drawings the leg means consists of a single centrally-positioned leg 38, 40, it is of course to be understood that the configuration of the leg means could be modified without departing from the spirit and scope of the invention. For example, two separate legs positioned at opposite sides of the front portion of the attachment 20 could be provided instead of a single central leg. The leg means may be formed as an integral part of the rest of the attachment 20, as in the preferred embodiment shown in the drawings, or it may be a separate member or members that are secured to the rest of the attachment 20. An integrally formed leg is preferred because it simplifies the manufacture, use, and cleaning of the attachment 20.

The preferred embodiment of the outer rim-gripping leg 38, 40 is best seen in FIGS. 2 and 7. The leg 38, 40 has an essentially straight upper portion 38 which engages the outer vertical surface 10 of the rim 6. The lower portion 40 of the leg 38, 40 bends rearwardly and downwardly from the upper portion 38 to extend under the outer bottom surface 18 of the rim 6. This shape of the preferred embodiment of the leg 38, 40 helps prevent any unintended movement of the attachment 20 relative to the rim 6 when the attachment 20 is in its use position.

Figure 9:
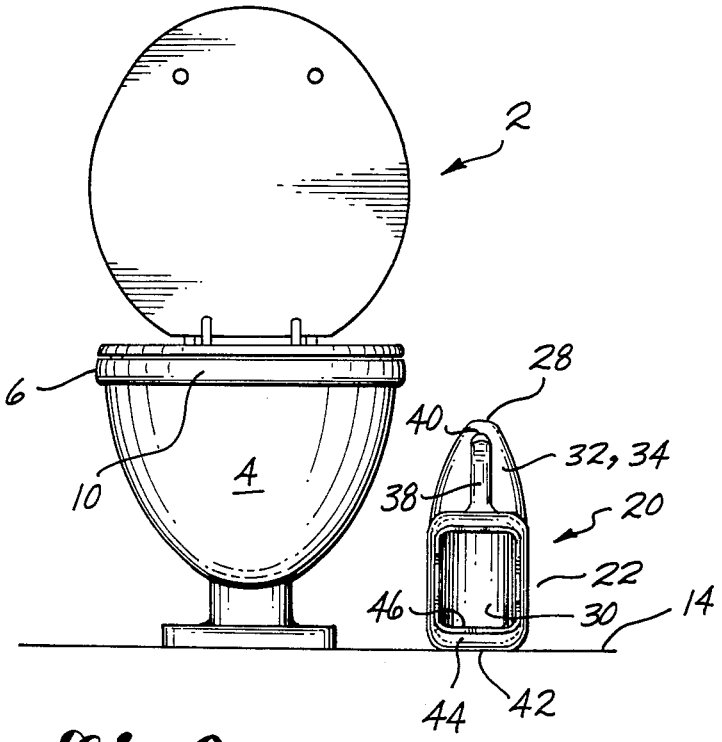
FIG. 9 is a front elevational view of the preferred embodiment of the attachment resting upside down on the floor next to a toilet.

In the preferred embodiment of the attachment 20, the receptacle 22 also includes a top wall 42 and a top lip 44 that depends generally downwardly from the forward edge of the top wall 42. The top wall 42 is essentially flat and is dimensioned and positioned to allow the attachment 20, when not in use, to be placed upside down on a flat surface, such as a floor, resting on the top wall 42. This makes it easy to store the attachment 20 in an inconspicuous place on the floor 14 beside a toilet 2. Such a position is illustrated in FIG. 9. As can be seen in FIG. 9, the attachment 20 is occupying a position similar to that frequently occupied by a toilet bowl brush, does not hinder free access to the toilet 2 and surrounding areas, and is readily available for reinstallation on the toilet 2. The top wall 42 and the top lip 44 form, along with the rear wall 24 and sidewalls 26 of the receptacle 22, a recess 46 for catching and containing any moisture that may be inside the attachment 20.

Preferably, the attachment 20 is provided with a handle 48. The handle 48 is attached to an exterior portion of the receptacle 22, preferably the upper rear surface of the rear wall 24 of the receptacle 22. The handle 48 greatly facilitates the installation of the attachment 20 on the toilet bowl 4 and the removal of the attachment 20 from the bowl 4. The handle 48 also makes it easy to set the attachment 20 upside down on the floor 14 and pick the attachment 20 up without soiling the hands or spilling liquid on the floor or other surfaces.

The preferred embodiment of the attachment 20 includes a substantially vertical funnel-like portion 32 that extends downwardly into the toilet bowl 4 for directing liquid down into the toilet bowl 4. The funnel 32 is formed by the inner rim-engaging wall 34 and downward extensions of the rear wall 24 and sidewalls 26 of the receptacle 22. The funnel 32 terminates in the outlet opening 28. The shape of the funnel 32 in the unmodified preferred embodiment is best seen in FIG. 2.

A modified form of the attachment 20' is shown in FIGS. 7 and 8. This modified form of the attachment 20' is the same as the unmodified attachment 20 except for the structure of the funnel portion 32'. In the modified attachment 20', the funnel portion 32' is provided with a cutout 52. Most of the rear wall and about half of the sidewalls are cut away to make the rear portion of the funnel 32' open. Thus, instead of the generally horizontal outlet opening 28 of the unmodified embodiment 20, the outlet opening 28' of the modified embodiment 20' extends generally horizontally and rearwardly, then extends upwardly, and then curves back to a horizontal orientation. This configuration of the outlet opening 28' and the open rear of the funnel 32' allow a person using the attachment 20' to see and aim at water in the toilet bowl 4. As noted above, the cutout feature of the funnel 32' of the modified embodiment is an optional feature that is particularly useful when a somewhat older child is using the attachment 20'.

The preferred embodiments of the attachment 20, 20' may be made from a variety of materials. Preferably, the attachment 20, 20' is a single integral molded plastic member. Such a member can be made to be very lightweight and is easy and inexpensive to manufacture. A molded plastic integral attachment also has the advantage of being very easy to clean.

The use of the attachment 20, 20' is illustrated in FIGS. 1, 2, and 7. As discussed above, a typical nonuse position of the attachment 20 is shown in FIG. 9.

It will be obvious to those skilled in the art to which the invention is addressed that the invention may be used to advantage in a variety of situations. Therefore, it is also to be understood by those skilled in the art that various changes, modifications, and omissions in form and detail may be made without departing from the spirit and scope of the invention as defined by the following claims.

What is claimed is:

1. A urinal attachment for mounting on the rim of a toilet bowl, comprising:

a receptacle having a rear wall portion and opposite sidewall portions defining a downwardly-directed outlet opening and a substantially vertical, forwardly-directed inlet opening;

a substantially vertical inner rim-engaging wall depending downwardly from and extending between said opposite sidewall portions and spaced rearwardly from said inlet opening for engaging an inner vertical surface of a front portion of said rim;

a generally horizontal wall extending generally forwardly from the top edge of said rim-engaging wall; and substantially vertical leg means depending downwardly from a forward portion of said horizontal wall for engaging an outer vertical surface of said front portion of said rim, said leg means being sufficiently flexible and resilient to permit the attachment to be removably positioned with said front portion of said rim securely gripped between said rim-engaging wall and said leg means;

said sidewall portions, rim-engaging wall, and horizontal wall being positioned and dimensioned to position the inlet opening forward of said inner vertical surface of said front portion of said rim, to help prevent spillage around said front portion.

2. An attachment as described in claim 1, in which said receptacle also has a top wall, and a top lip that depends generally downwardly from a forward edge of said top wall; said top wall being dimensioned and positioned to allow the attachment, when not in use, to be placed upside down on a flat surface resting on said top wall; said top wall and said top lip forming, with said rear wall portion and said sidewall portions, a recess for catching and containing moisture when the attachment is upside down; and said sidewalls and said top lip being positioned to prevent moisture from dripping out of the receptacle when the attachment is upside down.

3. An attachment as described in claim 1, further comprising a handle attached to an exterior portion of said receptacle, to facilitate installation and removal and handling of the attachment.

4. An attachment as described in claim 2, further comprising a handle attached to a rear surface of said rear wall portion, to facilitate installation and removal and handling of the attachment.

5. An attachment as described in claim 1, in which said generally horizontal wall slopes downwardly from said inlet opening to said outlet opening to prevent moisture from accumulating on said generally horizontal wall.

6. An attachment as described in claim 5, comprising a bottom lip extending generally upwardly from the forward edge of said generally horizontal wall to define the lower edge of said inlet opening.

7. An attachment as described in claim 1, in which said leg means includes an essentially straight upper portion depending downwardly from a forward portion of said horizontal wall for engaging said outer vertical surface of said rim, and a lower portion that bends rearwardly and downwardly from said upper portion to extend under said rim to help prevent unintended movement of the attachment relative to said rim.

8. An attachment as described in claim 4, in which said generally horizontal wall slopes downwardly from said inlet opening to said outlet opening to prevent moisture from accumulating on said generally horizontal wall.

9. An attachment as described in claim 8, in which said leg means includes an essentially straight upper portion depending downwardly from a forward portion of said horizontal wall for engaging said outer vertical surface of said rim, and a lower portion that bends rearwardly and downwardly from said upper portion to extend under said rim to help prevent unintended movement of the attachment relative to said rim.

10. An attachment as described in claim 1, comprising a substantially vertical funnel-like portion formed by said inner rim-engaging wall and downward extensions of said rear wall portion and said sidewall portions, for directing liquid down into the toilet bowl.

11. An attachment as described in claim 10, in which a rear portion of said funnel-like portion is open to allow a person using the attachment to see and aim at water in the toilet bowl.

12. An attachment as described in claim 1, in which the rim of the toilet bowl defines an upwardly-directed horizontal opening; and the receptacle is dimensioned to be smaller than said upwardly-directed opening to minimize areas of contact betwen the attachment and the toilet bowl.

13. An attachment as described in claim 2, in which the rim of the toilet bowl defines an upwardly-directed horizontal opening; and the receptacle is dimensioned to be smaller than said upwardly-directed opening to minimize areas of contact between the attachment and the toilet bowl.

14. An attachment as described in claim 4, in which the rim of the toilet bowl defines an upwardly-directed horizontal opening; and the receptacle is dimensioned to be smaller than said upwardly-directed opening to minimize areas of contact between the attachment and the toilet bowl.

* * * * *